US007159337B2

(12) United States Patent
Vicentini

(10) Patent No.: US 7,159,337 B2
(45) Date of Patent: Jan. 9, 2007

(54) FOOTWEAR ITEM AND METHOD OF MAKING THE SAME

(76) Inventor: Franco Vicentini, 305 The Linen Hall 162-168 Regent Street, London (GB) W1R 5TB ( * ) Notice: Subject to any disclaimer, the term of this patent is extended or adjusted under 35 U.S.C. 154(b) by 0 days.

(21) Appl. No.: 11/316,179

(22) Filed: Dec. 22, 2005

(65) Prior Publication Data

US 2006/0150440 A1 Jul. 13, 2006

Related U.S. Application Data

(62) Division of application No. 10/220,686, filed as application No. PCT/GB01/00924 on Mar. 2, 2001.

(30) Foreign Application Priority Data

Mar. 2, 2002 (GB) ..... 0005109.4

(51) Int. Cl.
*A43B 13/14* (2006.01)

(52) U.S. Cl. ..... 36/17 R; 36/16; 36/19 R; 36/22 R; 12/146 W; 12/142 D

(58) Field of Classification Search ..... 36/16, 36/17 R, 17 PW, 19 R, 22 R, 22 A; 12/142 D, 12/146 W
See application file for complete search history.

(56) References Cited

U.S. PATENT DOCUMENTS

| | | | | |
|---|---|---|---|---|
| 401,060 | A * | 4/1889 | Pillow | 36/88 |
| 4,308,671 | A * | 1/1982 | Bretschneider | 36/11 |
| 6,029,301 | A * | 2/2000 | Issler et al. | 12/142 B |
| 6,574,886 | B1 * | 6/2003 | Issler | 36/12 |

FOREIGN PATENT DOCUMENTS

| | | |
|---|---|---|
| BE | 564271 | 2/1958 |
| DE | 19517865 A1 | 5/1995 |
| EP | 0334038 A2 | 2/1989 |
| EP | 0573886 A1 | 6/1993 |
| EP | 0641526 A1 | 8/1994 |
| FR | 1.010.663 | 6/1952 |
| FR | 1.054.485 | 2/1954 |

* cited by examiner

*Primary Examiner*—Ted Kavanaugh
(74) *Attorney, Agent, or Firm*—Lawrence E. Laubscher, Jr.

(57) ABSTRACT

A footwear item includes an upper and a lap element. The lap element is formed of a moldable resilient plastic material with a predetermined shape and forms the sole or insole of the footwear item. The lap element includes opposing surfaces defining a channel for receiving the periphery of the upper. The predetermined shape of the lap element follows the perimeter of the upper.

13 Claims, 4 Drawing Sheets

Fig. 1
(PRIOR ART)
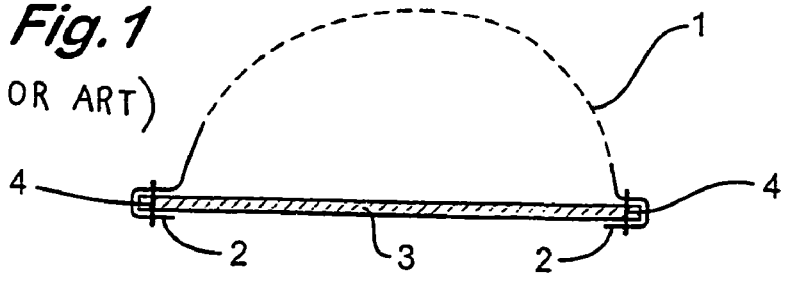
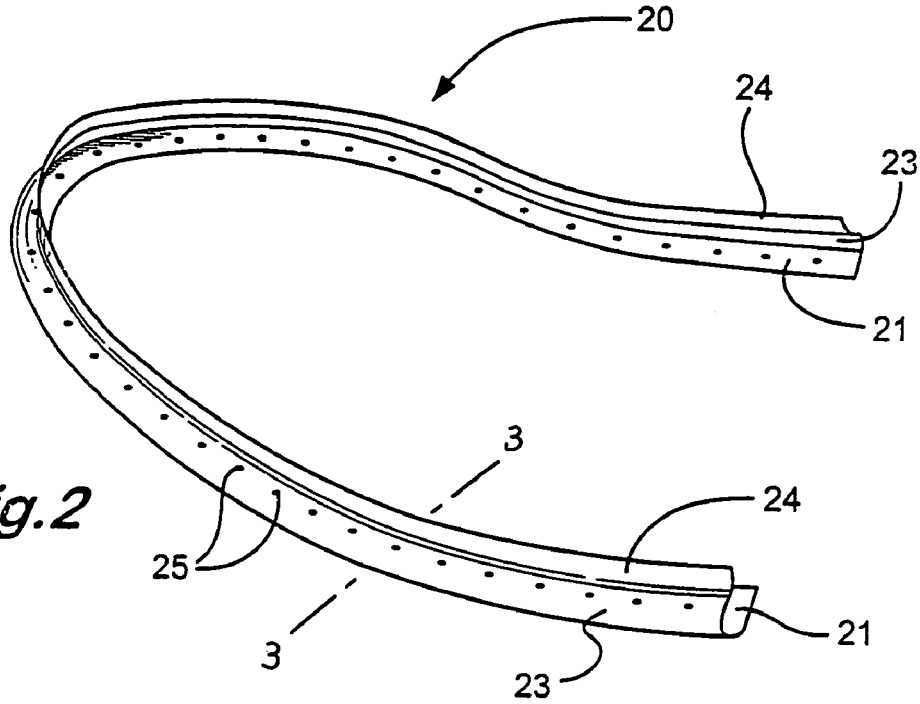
Fig. 2
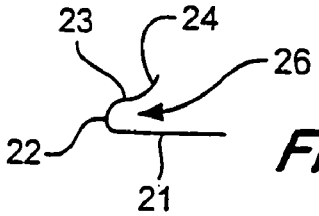
Fig. 3
Fig. 4
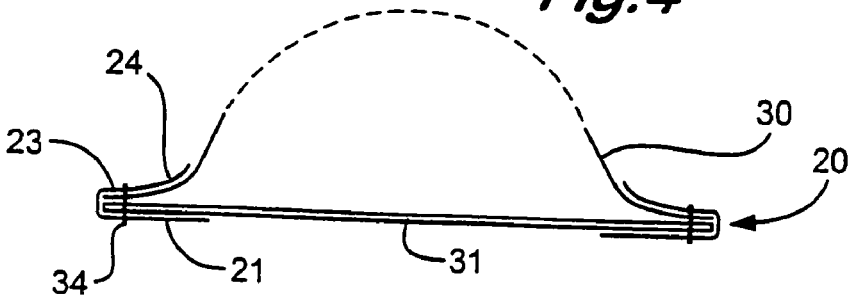

FOOTWEAR ITEM AND METHOD OF MAKING THE SAME

This application is a division of application Ser. No. 10/220,686, filed Sep. 3, 2002, which is a 371 of PCT/GB01/00924 filed on Mar. 2, 2001.

BACKGROUND OF THE INVENTION

The present invention relates to a footwear item and more particularly to the construction thereof.

In the present description, references to a lower surface will refer to the surface that is relatively nearer the ground and references to an upper surface will refer to the surface that is relatively further from the ground, when considered in the context of a user wearing the footwear item.

Footwear items comprise a sole, the lower surface of which contacts the ground when a user walks, and an upper, which together with the sole, defines a space into which a user inserts their foot. Usually, an insole is provided on the upper surface of the sole. The overall construction of the footwear item and the manner by which the upper and sole are fixed together to provide, for example, a shoe varies according to the cost parameters placed on the raw materials, the manufacturing process and the final retail price.

In the field of footwear and in particular in relation to shoes, there are a wide variety of constructions. For example, as is known in the art, the sole and upper can be fixed together using adhesives, nails, machine stitching, and hand stitching.

BRIEF DESCRIPTION OF THE PRIOR ART

A traditional shoe, known as a San Crispino shoe by those in the art, is shown in FIG. 1. In this case, an upper 1 is formed from leather. The upper includes a lap portion 2 which is folded over the perimeter or edge of an insole 3. Thus, the upper overlaps both sides of the periphery of the insole. A line of stitches 4 is then sewn at this periphery to form a seam which joins the upper and insole together. A sole (not shown) is then attached to the lower side of the insole, conveniently by stitching.

Typically, an upper is made from leather or an expensive artificial alternative. The aforementioned construction is wasteful of leather since the lap portion is part of the upper and hence comprises that same leather which is normally high grade and hence expensive. In addition, this construction is time consuming and difficult to manufacture since the lap portion must be carefully folded over the edge of the insole and be affixed thereto by some method. Whilst machine sewing can attach the lap portion to the insole, it is a highly skilled operation. Hand stitching is not a particular easy option since even if holes are pre-made in the main upper part, the lap portion, and the insole, due to the nature of the construction, it is extremely difficult to line up the various holes in the upper with those in the insole. Thus, such a shoe construction is time consuming and difficult.

An alternative construction to that above has been developed whereby the lap portion comprises a separate lap element comprising an elongate piece of leather, a flap, which is sewn onto the edge of the upper. This flap is then folded over the edge of the insole to be sewn thereto. This produces savings in leather material since lower quality leather can be used to form the flap. The upper, flap and insole are still sewn together in one operation, but it still remains extremely difficult to line up the holes ready for stitching. An additional problem with the above construction is that it is often desirable to mold a sole of plastic material onto the lower surface of the insole, for example by injection molding. However, the quality and thickness of the aforementioned flap varies so that it is difficult to accurately mate the sewn together upper and insole in a repeatable manner. This leads to significant variations in the appearance and size of the molded sole.

Another drawback of the aforementioned constructions is that there can be ingress of moisture into the shoe along the stitch line. This can lead to discomfort for the wearer and can limit the strength and durability of the footwear item due to decay of the stitching causing the seam to come apart.

SUMMARY OF THE INVENTION

It is an object of the present invention to provide a footwear item and construction thereof which will substantially overcome all the aforementioned problems.

According to one aspect of the present invention there is provided a footwear item comprising:

an upper; and a lap element formed from a resilient material to have opposing surfaces defining a channel therebetween whereby the upper is insertable into said channel with the lap element overlapping both sides of the periphery of the upper along a section of the perimeter thereof.

In this way, a channel is provided which assists with the location of the upper. Moreover, the alignment of any holes in the components of the footwear item is quicker and simpler thereby reducing the manufacturing costs. In addition, since the lap element is separate from the upper, it can be made separately and reliably thereby enabling a sole to be more reproducibly adhered or molded to the item. With such a lap element, it is also possible to avoid the use of leather thereby reducing raw material costs.

In one embodiment, the lap element is formed to extend around the whole of the perimeter of the upper.

As a consequence, the simpler manufacture of the item applies to the entire perimeter of the item.

In another preferred embodiment, the item comprises two or more lap elements.

As a consequence, it is possible to enlarge the design alternatives of the item by employing, for example, different surface relief and/or colors to the lap element. In addition, the lap elements can have different shapes. In one case, the lap element at the rear of the footwear item can be extended to provide a spoiler.

It is preferred that the section of the perimeter comprises a major part thereof.

Conveniently, the lap element is formed from a moldable material.

In this way, the lap element can be produced easily, accurately and reliably. Moreover, by using moldable materials, a wide variety of materials can be employed and raw material costs reduced.

It is preferred that said lap element is formed from a rubber like material.

Thus, the element can seal well to the upper.

In ore embodiment, said lap element is formed from thermal polyurethane (TPU).

This material is particularly suitable for the lap element since it is inherently stable, doesn't harden or cure further over time, it is light weight and is easy to mold.

Preferably, the lap element is provided with a series of holes corresponding to stitching holes. The holes may be molded in the lap element.

Since the lap element is resilient, the provision of such holes makes alignment of the holes during construction much simpler and quicker thereby reducing the costs associated with the manufacture.

It is preferred that the footwear item further comprises a sole attached to the upper.

In a particular embodiment, the lap element is integrally formed to provide a sole.

As a result, the number of components required to assemble and construct a footwear item is reduced thereby reducing the time and cost associated with manufacture.

In a particular embodiment, the lap element is integrally formed to provide an insole.

As a result, the number or components required to assemble and construct a footwear item is reduced thereby reducing the time and cost associated with manufacture.

In a particular embodiment, the footwear item further comprises an insole insertable with the upper into said channel with the lap element overlapping on both sides of the periphery of the insole and upper along a section of the perimeter thereof.

According to a further aspect of the present invention there is provided a method of forming a footwear item comprising the steps: a) forming a lap element having opposing surfaces defining a channel therebetween; b) inserting into the channel an upper with the lap element overlapping both sides of the periphery of the upper along a section of the perimeter thereof; and c) providing the lap element, with upper inserted, into a mold cavity and mold a sole to the lap element, the material of the sole fusing to the lap element.

Such a method provides a very simple and reliable process for the manufacture of a shoe, involving only three main steps.

Preferably, an insole is integrally formed with the lap element at step a. In this regard, the lap element and insole can be formed as a one-piece molding.

In preferred embodiments, the upper is stitched to the lap element before the lap element is provided into the mold cavity.

Conveniently, a molding form, configured with a flange to project into the channel of the lap element, is provided within the interior of the shoe during the molding process.

Preferably, the molding process is injection molding.

In preferred embodiments, the lap element is molded with a plurality of stitching holes.

According to a further aspect of the present invention there is provided a method of forming a footwear item, the method comprising: a) forming a lap element having opposing surfaces defining a channel therebetween; b) inserting into the channel an upper; and c) providing a form into the interior of the footwear item in preparation of finalizing formation of the footwear item, the form having a flanged element for projection into the channel of the lap element.

According to a further aspect of the present invention there is provided a footwear item comprising:

an upper; and a lap element for attachment to a sole and formed from a resilient material to have opposing surfaces defining a channel therebetween, whereby the upper is insertable into said channel, wherein the lap element is formed with a predetermined shape which follows the perimeter of the upper.

According to a further aspect of the present invention there is provided a form for use in the manufacture of a footwear item, the form comprising:

a main element conforming to the general interior shape of the footwear item; and a flanged element provided around at least part of a lower periphery of the form.

BRIEF DESCRIPTION OF THE FIGURES

Examples of the present invention will now be described with reference to the accompanying drawings, in which:

FIG. 1 illustrates a cross section through a known traditional San Crispino shoe taken across the shoe at the ball of the foot;

FIG. 2 illustrates an oblique perspective view of a lap element for a footwear item embodying the present invention;

FIG. 3 illustrates a cross section through the lap element of FIG. 2 along the line 3—3;

FIG. 4 illustrates the construction of a footwear item which uses the lap element shown in FIGS. 2 and 3;

Figure 5:
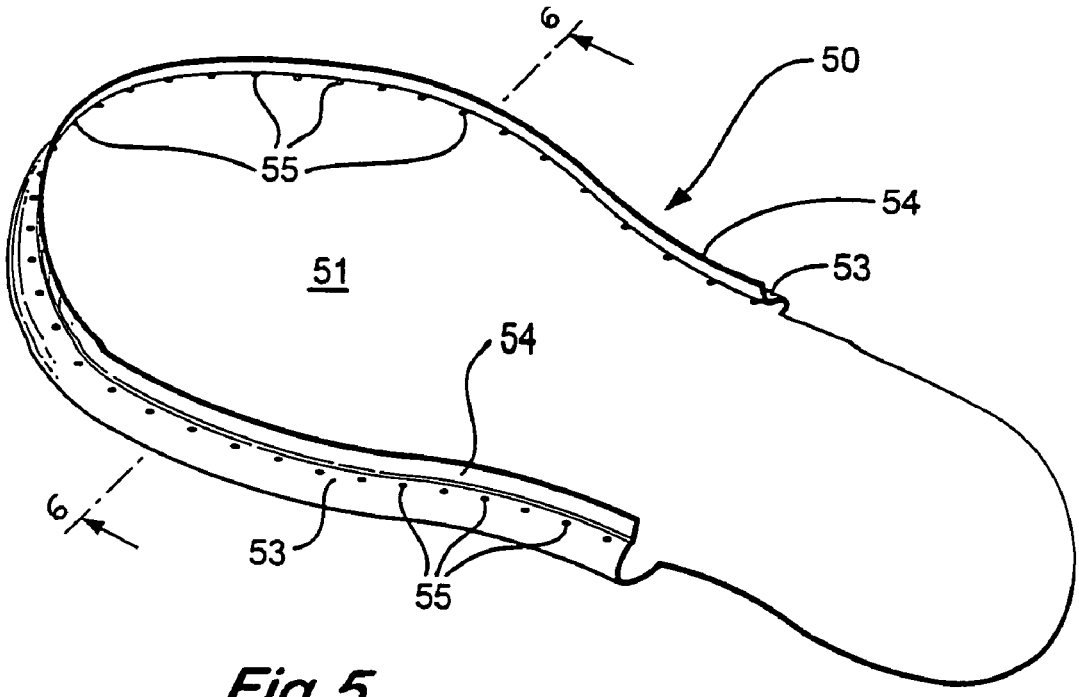
FIG. 5 illustrates a lap element integrally formed to provide an insole.

It will be appreciated that the figures shown in this description are not to scale.

BRIEF DESCRIPTION OF THE FIGURES

Referring to FIGS. 2 and 3, a lap element 20 is injection molded as a single integral piece of plastic material. The lap element is elongate with a curvature in the form of a horse shoe. It has been found that TPU (thermal polyurethane) is an ideal material since it is inherently stable, does not harden or cure further over time, it is light weight and is easy to mold. As can be seen in particular from the cross section in FIG. 3, the lap element 20 has a lower flange 21 which extends width ways to curve round at a point 22 to meet an upper flange 23 opposed to the lower flange 21. Thus, a channel 26 is formed between the opposing flanges 21 and 23. The upper flange has a relatively smaller width than the lower flange and includes a generally upstanding lip 24. A series of holes 25 are formed in both the upper flange and the lower flange. The holes are formed in the lap element as part of its molding process and therefore do not require separate processing. The holes may be equidistantly spaced, the holes in the upper flange matching those in the lower flange.

It is preferred that the lap element is formed from a flexible rubber like resilient material, although a relatively harder material could be used. Since the lap element is not formed from leather, and can be produced easily from a molded material, considerable cost savings in raw materials are provided. In addition, by use of molded plastic materials, considerable scope for design alternatives are provided compared with such prior art types of footwear items. For example, varying colors and/or surface relief can be provided extending from the point 22 towards the lip 24.

The lap element is formed so that it has a predetermined shape that follows or matches its associated upper. The lap element does not therefore need to be cut or bent into shape in construction of the shoe, thereby greatly simplifying-the manufacturing process and making it much more reliable.

To begin construction of a footwear item, an upper 30 is cut to the required size. The perimeter of an insole board 31, preferably formed from latex, is inserted into the channel 26 along with the perimeter of the cut upper such that the flanges 21 and 23 overlap both sides of the periphery of the insole and upper along the perimeter. It is preferred that the insole and upper have a series of holes preformed therein, which may be equidistant and corresponding with the holes 25 in the flanges.

Figure 10:
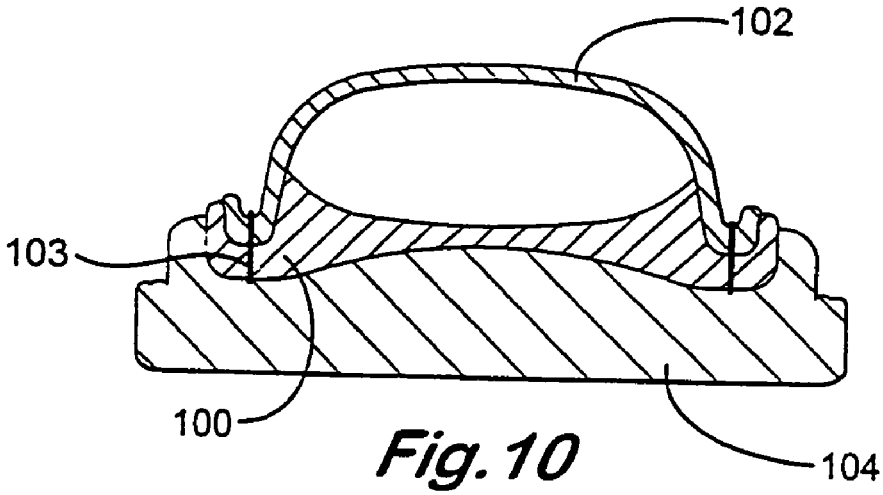
FIG. 10 shows the lap element of FIG. 9 coupled to an upper and a sole.

Thereafter, a line of stitches 34 is sewn at this periphery through the preformed holes. As the stitches are drawn tight, the periphery region at the perimeter of the insole and upper is sandwiched between the lower and upper flanges 21 and 23 and firmly fixed therebetween. Thus, a watertight seal is created.

Where the holes in the lap element are vertically aligned, as shown in FIGS. 4 and 10, the stitching of the lower seam is protected behind the sole as opposed to being exposed to the outside.

In a modification of the lap element, the holes provided therein may however be staggered. In this modification, the holes provided in the lower flange are positioned so that they are not vertically aligned with the holes in the upper flange, but rather are inclined outwardly from the vertical. In this way, and as is shown by way of example in FIG. 11, a person sewing the shoe has more room in the area "X" to work. Clearly, in the embodiment or FIG. 11 where the upper is sewn to the combined lap element and sole, if the hole in the lower flange were provided in vertical alignment with the hole in the upper flange, there would be far less room in which to work.

The holes may moreover be non-uniform or non-equidistant so that their spacing is different along the sides of the insole from that at the heel and toe areas. This can be for aesthetic reasons, but also since in curved areas of the periphery of the shoe, such as toe and heel areas, the material of the upper has to be gathered to an extent. As such, more holes are generally required at these points of curvature to avoid the upper forming into a waved configuration at its connection with the lap element.

As the lap element is resilient, the alignment of the lap element, insole and upper is considerably simpler than with the traditional San Crispino shoe. This leads to considerable cost savings in the manufacture of such a shoe. Moreover, the thickness of the lower flange can be consistently and accurately set in both width and in thickness so that a sole (not shown) can be directly adhered to or molded onto the lower surface of the flange 21 and insole 31 in an accurate and reproducible manner. Thus, the appearance of a San Crispino shoe is provided with a simple molded or adhered sole.

Figure 6:
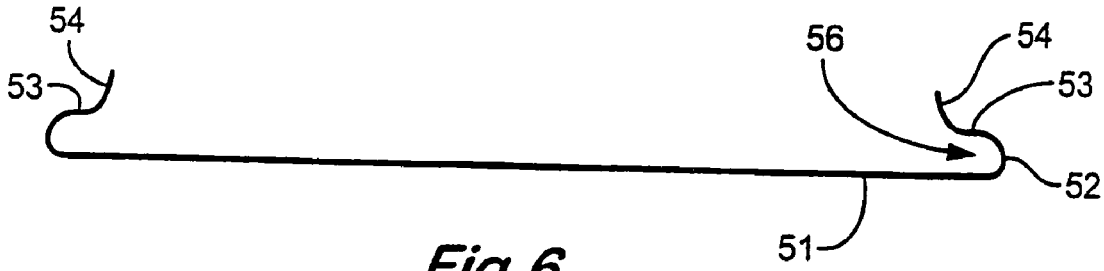
FIG. 6 illustrates a cross section through the lap element of FIG. 5 along the line 6—6.

Referring to FIGS. 5 and 6, an improved lap element 50 is shown. In this case, the lap element has an insole integrated therewith, the whole being formed in the same manner and with the same materials as the lap element described with reference to FIGS. 2 to 4. This lap element is therefore formed as a single molding process, preferably an injection molding process. The lap element 50 has a lower flange 51 which extends across the entire part on which a foot is to rest in the final shoe, in effect forming the insole. At the outer edge of the flange 51, the material thereof extends to curve round at a point 52 to meet an upper flange 53 opposed to the outer edge region of the lower flange 51. Thus, a channel 56 is formed between the opposing flanges 51 and 53. The upper flange includes a generally upstanding lip 54. A series of equidistant and corresponding holes 55 are formed in both the upper flange and the lower flange. These holes are formed as part of the injection molding process of the lap element.

To begin construction of a footwear item incorporating this lap element, an upper 30, cut to the required size and with corresponding preformed holes, is simply inserted into the channel 56 and a line of stitches 34 is sewn through the corresponding holes. Thus, a separate insole is not required. Furthermore, the lining up of holes during construction is significantly simpler than the construction shown in FIG. 4. Moreover, the lower surface at this construction stage is completely flat compared with the construction of FIG. 4 thus improving adhesion or molding of a sole thereto. Indeed, the construction of FIGS. 5 and 6, which is essentially a three part construction, opens up the possibility of automated construction of shoes.

Figure 11:
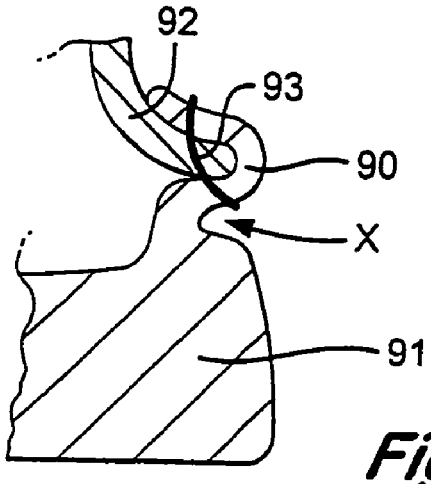
FIG. 11 shows a cross-section of a further lap element construction together with an upper.

The possibility of automated construction of shoes is further enhanced by using a sole with a side channel for sewing since the sole can be pre-adhered or molded to or with the lap element 50 so that all that is required is the insertion of the upper into the channel 56 followed by sewing to attach the upper, which is essentially a two part construction. Such a possibility is shown in FIG. 11, where the lap element 90 is formed integrally with the sole 91 and attached to an upper 92 with stitching 93.

Figure 7:
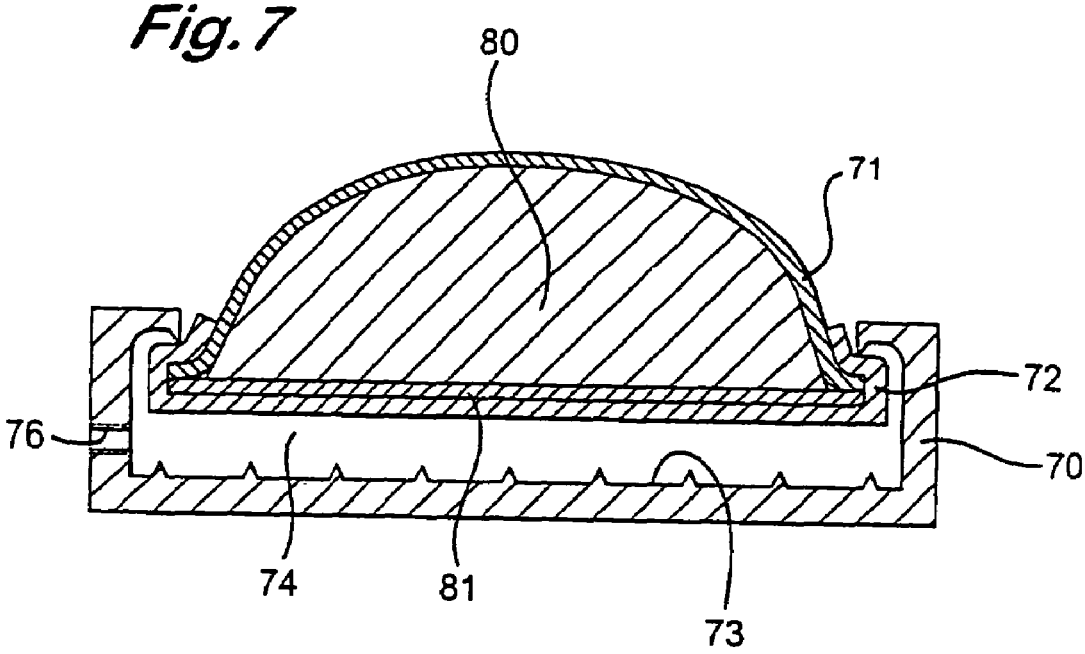
FIG. 7 illustrates a manufacturing method of the present invention.
Figure 8:
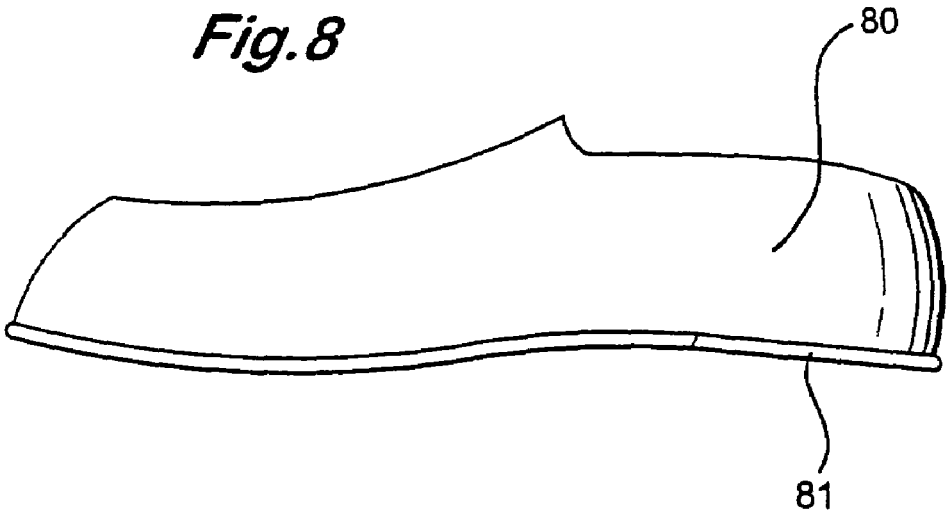
FIG. 8 shows molding form for use with the method of FIG. 7.

A further method of forming a footwear item is shown in FIGS. 7 and 8.

As depicted in FIG. 7, the upper elements of a shoe have been provided to a mold 70. These elements include an upper 71 and a combined insole/lap element 72. The upper components of the shoe may be formed according to the embodiments described above, with the insole and lap element being provided integrally (as a one-piece molding) or may be provided as separate parts, joined to the upper.

Between an under face of the insole 72 and an inner surface 73 of the mold 70 is formed a cavity 74. Into this cavity is provided suitable material to form the sole of the shoe. Such material may comprise plastic or elastomeric materials, which can fuse or bond with the insole, without the need for additional attachment means.

The material may be injected into the cavity via port 76 such that the manufacture of the soles is by injection molding.

In order that the shape and alignment of the elements of the shoe are maintained correctly during the molding process, a molding form 80 is placed within the shoe's interior. The form 80 includes a flanged element 81 which projects into the area of the lap element to thereby ensure that the spacing of the opposing sides of the lap element is maintained as desired during the molding process.

Clearly, if the lap element does not extend around the entire periphery of the upper, then the flanged element can be accordingly formed.

The molding form 80,81 may be provided in any suitable material, with the possibility that the flanged element 81 is detachably mounted to the main form 80.

It should be noted that the form 80,81 may be used to securely hold the components of the footwear item together also in the event that the components are glued rather than attached as part of a molding process. The form therefore can hold the components in correspondence and maintain the shape of the lap element, allowing the components to be correctly aligned. The flanged element 81 can be used to keep the rim in shape when, following application of the glue the components are pressed together in suitable press apparatus. Without the flanged element, a rim formed from the lap element, may be distorted and for example become asymmetric.

Figure 9:
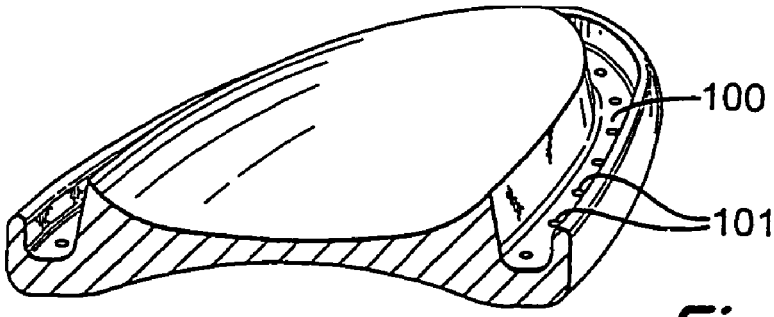
FIG. 9 shows a cut away section of a further lap element of the present invention.

In FIGS. 9 and 10 there is shown a further embodiment of the present invention. In these figures the lap element is again molded to present a channel 100 with molded holes 101. On formation of the footwear item an upper 102 is inserted into the channel and stitched 103 thereto, making use of the pre-formed holes 101. The lap element with attached upper is then attached to a sole 104, for example by molding a sole thereto as described above, or by adhering a sole thereto. attached upper is then attached to a sole 104, for example by moulding a sole thereto as described above, or by adhering a sole thereto.

The present invention has been described in the above forms only by way of example and is capable of considerable modification, the details of which will be readily apparent to those skilled in the art. For example, it will be appreciated that the lap elements have been described and shown as extending only around the major part of the shoe by the ball of the foot. However, the present invention is not limited in this way and the lap element can extend around the entire perimeter of the footwear item,. Alternatively, more than one lap element can be employed and indeed different lap elements can be used to provide different design presentations. For example, the lap element at the rear of the shoe can incorporate an extended lip 24 such that a spoiler is provided.

Although the present invention has been described with particular reference to San Crispino shoes, it will be appreciated that the term "shoe" is to encompass other types of footwear wherein the above construction can be applied.

The invention claimed is:

1. A method of fabricating a footwear item comprising the steps of (a) forming an upper having a perimeter of defined shape;

(b) forming a lap element for attachment of said upper to a sole, the lap element having upper and lower flanges defining a channel to accommodate a section of at least the perimeter of said upper and being formed of a plastics material molded to conform to the shape of said section of said upper;

(c) molding a series of holes into each of said upper and lower flanges of the lap element to accommodate stitching for securing said section of said upper between said upper and lower flanges of the lap element and to the sole;

(d) forming in the periphery of said section of said upper a series of holes corresponding with those in the upper and lower flanges of said lap element; and (e) providing said lap element with sufficient resilience to accommodate alignment of the corresponding holes in said lap element and said section of the upper of the footwear item, thereby facilitating said stitching.

2. A method according to claim 1, wherein said lap element is formed to extend around the entire perimeter of said upper.

3. A method according to claim 1, utilizing two or more of said lap elements.

4. A method according to claim 1 wherein said section of the perimeter of said upper comprises a major part thereof.

5. A method according to claim 3 wherein said section of the perimeter of said upper comprises a major part thereof.

6. A method according to claim 1, wherein said lap element is formed from TPU.

7. A method according to claim 1, and further comprising attaching a sole to said upper.

8. A method according to claim 1, wherein said lap element is formed integrally with a sole.

9. A method according to claim 1, wherein said lap element is formed integrally to provide an insole.

10. A method according to claim 1, and further comprising inserting an insole with said upper into said channel with the upper and lower flanges of said lap element overlapping on both sides of the periphery of said insole and upper along a section of the perimeter thereof.

11. A method according to claim 1, and further comprising providing a form into the interior of the footwear item in preparation of finalizing formation of the footwear item, the form having a flanged element for projection into the channel of said element.

12. A method according to claim 11, and further comprising providing said lap element, with said upper-inserted, into a mold cavity and molding a sole to said lap element, the material of the sole fusing to said lap element.

13. A method according to claim 11, and further comprising providing a form comprising a main element conforming to the general interior shape of a footwear item; and a flanged element provided around at least part of a lower periphery of the form.

* * * * *